US006516758B1

(12) United States Patent
Leiber

(10) Patent No.: US 6,516,758 B1
(45) Date of Patent: Feb. 11, 2003

(54) ELECTROMAGNETIC DRIVE

(76) Inventor: Heinz Leiber, Theodor-Heuss-Strabe 34, D-71739 Oberriexingen (DE)

( * ) Notice: Subject to any disclaimer, the term of this patent is extended or adjusted under 35 U.S.C. 154(b) by 0 days.

(21) Appl. No.: 09/856,010

(22) PCT Filed: Nov. 15, 1999

(86) PCT No.: PCT/EP99/08785

§ 371 (c)(1),
(2), (4) Date: May 16, 2001

(87) PCT Pub. No.: WO00/29723

PCT Pub. Date: May 25, 2000

(30) Foreign Application Priority Data

Nov. 16, 1998 (DE) ..... 198 54 020
Jan. 13, 1999 (DE) ..... 199 00 933

(51) Int. Cl.[7] ..... F01L 9/04

(52) U.S. Cl. ..... 123/90.11; 251/129.01; 251/129.16

(58) Field of Search ..... 123/90.11; 310/268, 310/216, 215; 335/128, 131, 256; 251/129.01, 129.15

(56) References Cited

U.S. PATENT DOCUMENTS 4,458,370 A * 7/1984 Fickler ..... 5/71
4,686,501 A * 8/1987 Palmier et al. ..... 335/256
4,762,095 A * 8/1988 Mezger et al. ..... 123/90.11
4,900,965 A * 2/1990 Fisher ..... 310/216
5,016,904 A * 5/1991 Weber ..... 280/664
5,161,494 A * 11/1992 Brown, Jr. ..... 123/90.11
5,762,035 A * 6/1998 Schebitz ..... 123/90.11
5,791,442 A * 8/1998 Arnold ..... 188/138
6,262,498 B1 * 7/2001 Leiber ..... 310/12

FOREIGN PATENT DOCUMENTS

DE 0245614 A 11/1987
DE 29706491 U 8/1998
WO WO98/42953 10/1998
WO WO99/06677 2/1999

* cited by examiner

*Primary Examiner*—Thomas Denion
*Assistant Examiner*—Ching Chang
(74) *Attorney, Agent, or Firm*—Woodbridge & Associates, P.C.; Richard C. Woodbridge, Esq.

(57) ABSTRACT

Disclosed is an electromagnetic drive, comprising and armature that can move electromagnetically back and forth. The movement of the armature drives a valve of an internal combustion engine. The ratio of the depth of the yoke in relation to the width of the yoke of the electromagnets and the length of the armature in relation to the width of the armature is greater than 1.5 in order to reduce the power consumption of the drive.

44 Claims, 11 Drawing Sheets

ELECTROMAGNETIC DRIVE

BACKGROUND OF THE INVENTION

Field of the Invention

The invention concerns an electromagnetic drive having the characteristics of the preamble superordinate claim 1.

DE 197 120 63A1 or the publication of the corresponding international application PCT/EP 98/01719 1 describes an electromagnetic drive.

The paramount objective in the design of such drives is to achieve the smallest possible losses in the air gap and in the magnetic circuit of the electromagnet and the least possible weight of the moveable mass. In order to achieve said objective, an integration of the armature into an orientable armature lever in accordance with the cited state of the art. Since the laws of physics relate the mass of a rotational system is to the square of transmission, the ratio of the distance of the armature from the fulcrum of the lever to the distance of the point of action on the element to be motivated by the fulcrum was chosen to be less than 1.

SUMMARY OF THE INVENTION

The purpose of the invention is to provide a further possibility of reducting the electrical losses of the drive and of the weight of the motivated mass.

The disclosure describes drives in accordance with the cited state of the art but also those drives, whose armatures describe a point to point movements.

The subordinate claims contain advantageous alternative embodiments of the invention.

The minimum one electromagnet described in the disclosure must have at least one active; that is, lift producing, pole.

Preferably, the armature is driven by two electromagnets; however, as will be shown in the following, the drive is also realizable by means of a coil, that practically cooperates alternatively with the different poles. Preferably, the electromagnet or electromagnets are designed as bipolar; however, electromagnets with more than two poles are also conceivable; for example, even pot-shaped magnets. In the case of a bipolar design and orientable bearing of the armature a design is also possible, in which only one of the poles is active; that is, directly effects an attraction of the armature—thus performs lifting work—while the other pole provides only the return flux over the armature bearing. In the combination of these modalities a solution using one electromagnet and one active pole is conceivable.

The following considerations resulted in the inventive dimensioning of the drive: Principally, the armature mass is determined by the requirements in accordance with maximal drive power. Here, the limiting dimension is the flux density in the magnetic circuit at which saturation occurs. Dimensioning of the armature is determined by the overall yoke breadth and the yoke length. The overall yoke breadth is then again determined by the distance between the two limbs, which is determined in accordance with considerations of magnetic scatter loss. In general, the overall yoke breadth should be kept as small as possible. Optimization of the armature weight is now possible in that the yoke breadth is kept as narrow as possible with the deepest possible yoke depth. In order to minimize the weight, a ratio of yoke depth to the overall yoke breadth comes into play, which is unusual for magnets. Conventionally, magnets are generally dimensioned in such a way that the ratio of breadth to length results approximately in a square. In order to achieve minimal armature weight in the invention, a ratio is selected that is greater than a factor of 1.5, in particular greater than 2 and preferably greater than 3. The result is thus a relatively long, thin armature that must be appropriately mounted.

By dimensioning a long magnet, the magnet can be over-dimensioned in the power balance which has special advantages; for example, for the opening magnet of the exhaust valve or the shutting magnet of the inlet valve, which must overcome the forces of the gas. In the familiar system using an armature lever described above the torsion bar is used simultaneously as the bearing point for the armature lever. In this case, the torsion bar is subjected to an additional flexural load. When dimensioning a long magnet with a correspondingly long armature, according to the invention this is not possible; therefore, pursuant to a further embodiment of the invention, the armature is connected via one or several armature levers to a tube, which is mounted at least on both sides and absorbs the bearing force. The torsion bar can be situated on the inside of the tube and it is completely unburdened by additional flexural forces.

Along with the longitudinal expansion of the valve and the cylinder head the system must be adjustable to the relatively large tolerances of the valve, the valve seat, the cylinder head and the drive housing. To achieve this, it is recommended that the housing is rotatable around the axis of rotation of the armature tube or even around that of the torsion bar or around another axis of rotation away from the armature the housing lies in a bearing pit and is fastened via a cushioning counterbearing. Adjustment is done, for example, by means of two nuts, whereby one nut represents the so-called anvil and is shifted to adjust and the second nut is used for the purpose of securring.

A further enhancement is represented by an arrangement of the magnetic circuit whereby grain-oriented material is inserted, which is economical and reaches saturation in the region of 1.9 Tesla. At the onset of saturation, normal magnet material exhibits a flux density of 1.4 Tesla. Thus, a considerable power increase per unit of area is possible and this results in smaller magnets and reduced armature masses.

A long magnet with high pole area has, however, disadvantages in inductivity and thus in time response; therefore, it is recommended, division of the yoke limb and insertion of two coils. The construction described for the long magnets additionally has the advantage tht the structural width is relatively small, which again permits a relatively low cylinder head. A cost factor is the layout of the coils. Frequently, the yoke is divided when inserting the coils into the magnetic circuit; this means losses at the junctions. In the inventive design the coils are constructed in such a way that they can be installed in the window bwteen the two limbs of the yoke. Correspondingly the maximum width is measured.

A particular problem is presented by the requirements for small time constants with relatively large magnets with corresponding inductivity. A small time constant is required for the purpose of position adjustment and is thus achieved in that the valve is seated with low speed. For this to happen, it is necessary that the magnetic circuit reacts quickly to the respective control signals. This is achieved in that, as described above, by the partitioning of the yoke several coils are used and are switched in parallel. For example, four coils can be provided which can be switched together in parallel. Since these coils, in comparison to one coil, have the same time constants, in less than a quarter of the time the required linkage/permeation is achieved. The job of the magnets is, on the one hand the performance of the lift work for the purpose of the mechanical and the gas losses. On the other hand, a closed or an open valve position should be achieved by the armature in its terminal positions. Over 70 percent of the operating cycle is used for the closed position. In order to keep the required holding energy low the coil current is switched/clocked. However, a separate holding coil can be used. By using said holding coil with the appropriately large number of windings the holding energy; that is, the output, can be drastically reduced. In order to provide for a favorable heat removal the coils are relatively thin and have a relatively large surface thanks to the advantage of the long magnet. In addition, filler pieces between yoke and coil body can be installed for enhanced heat removal. Said filler can be laminated and made of material that has good heat conducting properties but it can also be magnetic material for the purpose of reduction of the ferric [magnetic] losses. There are also possibilities for combining of both methods. The coils are preferably imbedded into the base body and they can in certain cases also be extruded into it.

A large problem is presented by the control of the various longitudinal expansions undergone by the cylinder head and the valve during warm-up. Per the state of the art hydraulic elements are frequently used to even out the play or magnets with large air gap are used. The elements used for hydraulic compensation of play are very expensive and are limited in compensating play, since there is also the risk that the drive is operated outside of its centerline. As in the state of the art described above, an overstroke spring can also be used. With the additional use of temperature compensation in the housing or in the valve, the overstroke is relatively slight; for example, it is limited to a couple tenths of a millimeter and has a less powerful effect on the holding energy at a relative low translation ratio of magnet to valve axis. This overstroke spring has the advantage that at seating; that is, on closing of the valve, generally only the valve mass acts as an impact load or stress. The remaining mass is decoupled by the overstroke spring. Preferably, the overstroke spring is constructed so that the majority of the mass sits upon the small arm of the lever and thus does not directly flow into the effective mass. At the same time the magnet can be brought onto a smaller air gap. The remaining air gap must be dimensioned so that it overcomes the actual valve seal and a temperature expansion without the armature being fully supported. If the armature rests before the valve closes, there would be no valve seal.

There are various possibilities for the transfer of the drive force from the armature to the valve. The least magnetic power and motivated masses and thus also energy requires a direct coupling of the valve to the armature movement.

It is, however, also possible to uncouple the valve via its own, conventional valve compression spring. In this instance the torsion spring and/or a tension or compression spring can provide the necessary counter force. These solutions offer advantages in assembly, but are disadvantageous because of the larger masses motivated, greater magnetic force, and higher energy requirements.

The invention will be described in more detail using the following examples of embodiments.

Wherein:

BRIEF DESCRIPTION OF THE DRAWINGS

FIG. 2: depicts a detail of FIG. 1;

DESCRIPTION OF THE PREFERRED EMBODIMENT

Figure 1:
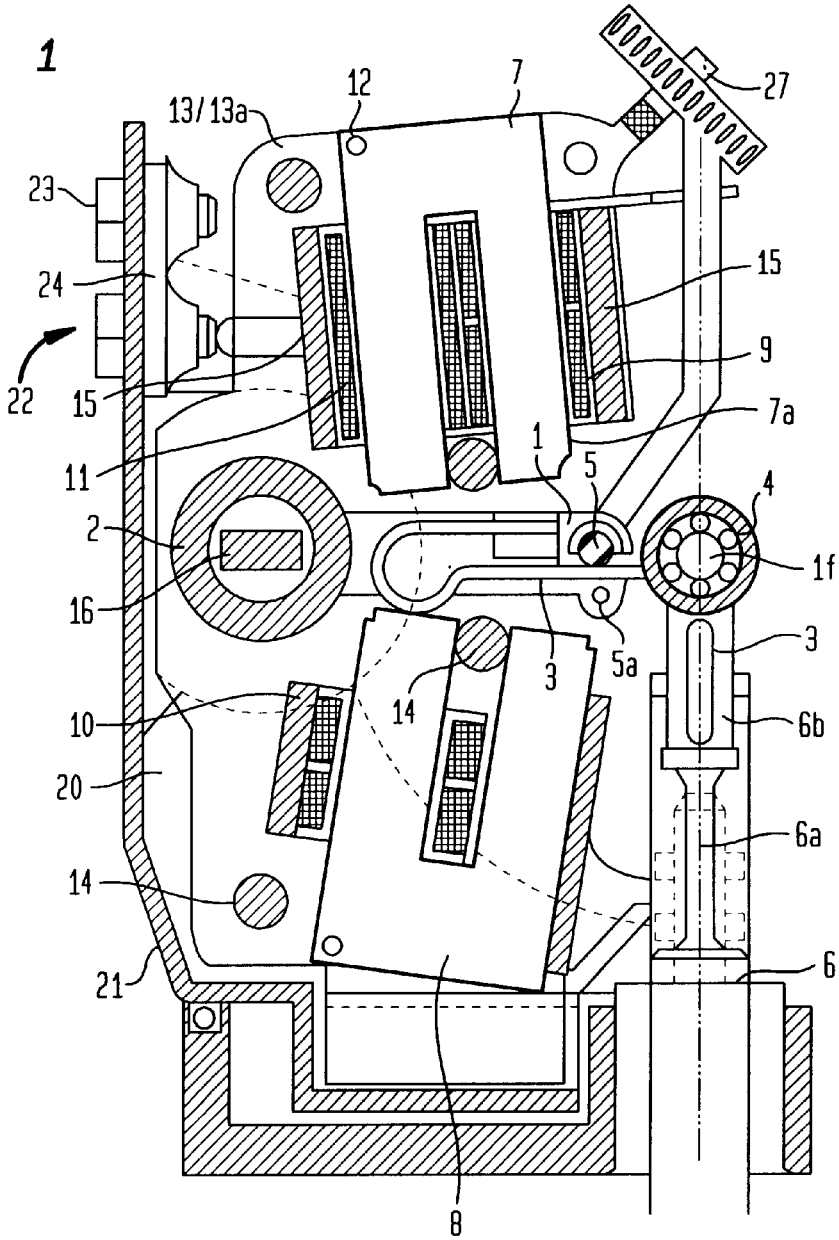
FIG. 1: depicts a lateral view of an electromagnetic drive.

In FIG. 1 an armature lever 1 is connected with a section of tubing. It transfers the forces for activation of the valve via an overstroke spring 3 on the bearing housing 1*f* with a bearing 4 on a valve stem. The valve stem exhibits a flexible valve stem element 6*a*. The overstroke spring 3 requires a prestressing; it can be adjusted using an adjustment element, for example an eccentric 5. A second stop 5*a* limits the overstroke. The function of the overstroke spring is described in more detail in the state of the art mentioned above.

The magnet systems are comprised of a closing magnet 7 and an opening magnet 8. In the embodiment example the opening magnet 8 is depicted larger than the closing magnet, because it must produce a greater lifting force in the exhaust valve on opening in order to overcome the force of the gases. Both magnet yokes are constructed in one piece and manufactured out of grain-oriented material, which allows only slight ferric [magnetic] losses with high flux densities. In areas with a change of direction of the yoke the yoke can exhibit a expansion to greater cross-sections. A smaller cross-section In and the grain oriented optimal flux direction can be incorporated into the yoke limbs. The magnets each have two double coils 9 and 10. Said double coils are present double in each yoke limb, if the yoke is partitioned. The double coils are switched in parallel inorder to make produce reduced inductivity and thus achieve faster time response. Nevertheless, they can also be operated as single coiles or in series circuit.

Figure 4:
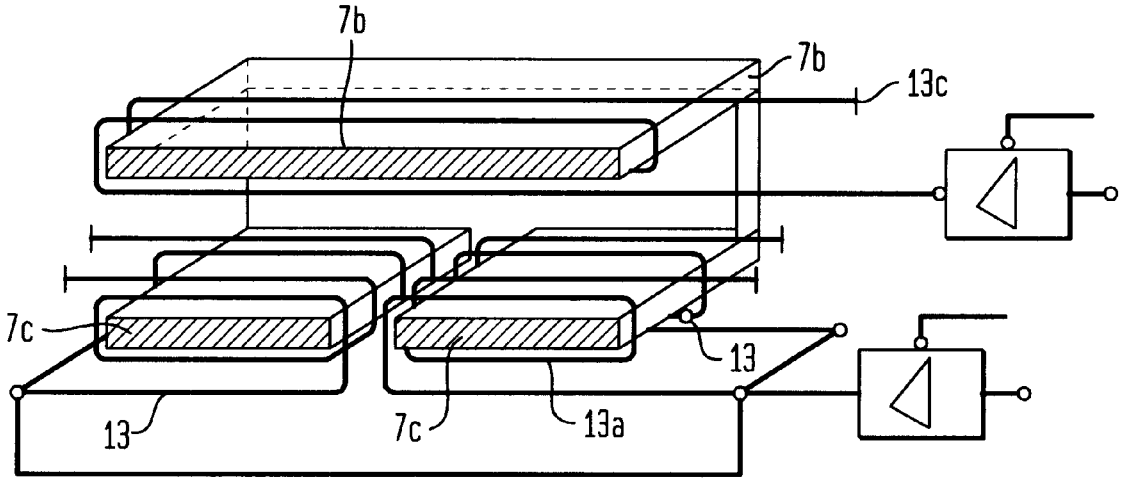
FIG. 4: depicts the possible configurations of the yoke of an electromagnet.

FIG. 4 depicts two possible yoke arrangements with an partitioned 7*c* and a closed limb 7*b*. The partitioned limb sections are enclosed by two double coils 12 and 13*a*. In this case one or even two output stages can be used. The coils are connected in parallel. It is also conceivable, however, that they can be shorted entirely or in part for the purpose of braking the armature.

In the more advantageous configuration with undivided limbs 7*b* of the yoke 7 a holding coil 13*c* is mounted on it.

The magnets 7 and 8 are fastened in FIG. 1 each via a centering pin 12. Said pin protrudes on both sides into two housing plates of which only the rear one 13 is visible. The magnets are fixed via relatively long bolts 14, whereby the bolts between the yokes must not be magnetic. Tensioning is done after the magnet yoke is adapted to the armature so that uniform air gaps result. Better heat removal for the magnet coils is achieved by appropriate formal design of the plates.

The coils are imbedded by appropriate elevations 15 of the base plates 13 and 13*a* so that the result is satisfactory heat removal on both sides.

The entire drive is mounted on both sides in bearing supports consisting of extensions 20 of the actuator box (21). Said extension is depicted in broke lines behind the magnet 9. The counter-bearing is formed by appropriate recesses in the housing 13.

The cushioning counter-bearing 22 is fastened to the actuator box 21 with two screws 23. All drives of a cylinder bank are housed in said actuator box.

Figure 1A:
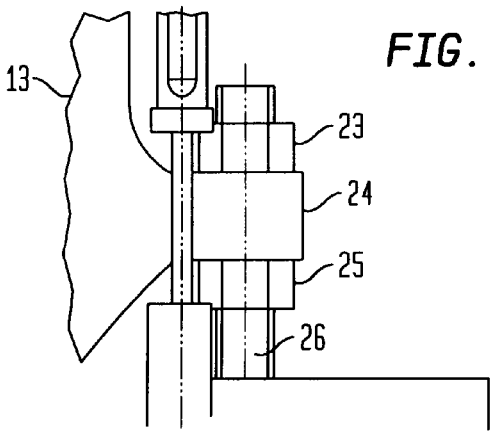

The housing 21 is adjusted and fixed using two nuts. Said arm is behind the valve shaft 6, 6*a* and the centering of the valve fork 6*b* is shown in broken lines and enlarged in FIG. 1*a*. The arm 24 of the housing 13 is fixed with two bolts 25. When adjusting, they are turned on the screw 26 until the correct adjustment of valve and armature positon is established over the lift sensor 27. For fixation the upper nut is countered. As an alternative, for example, two screws can be used, whereby, again, the first screw forms the anvil for the housing and the second screw is used for securing.

A torsion spring 16 lies in the bore of the armature tube 2. The armature is shown in more detail in FIGS. 2*a* and 2*b*.

Figure 2A:
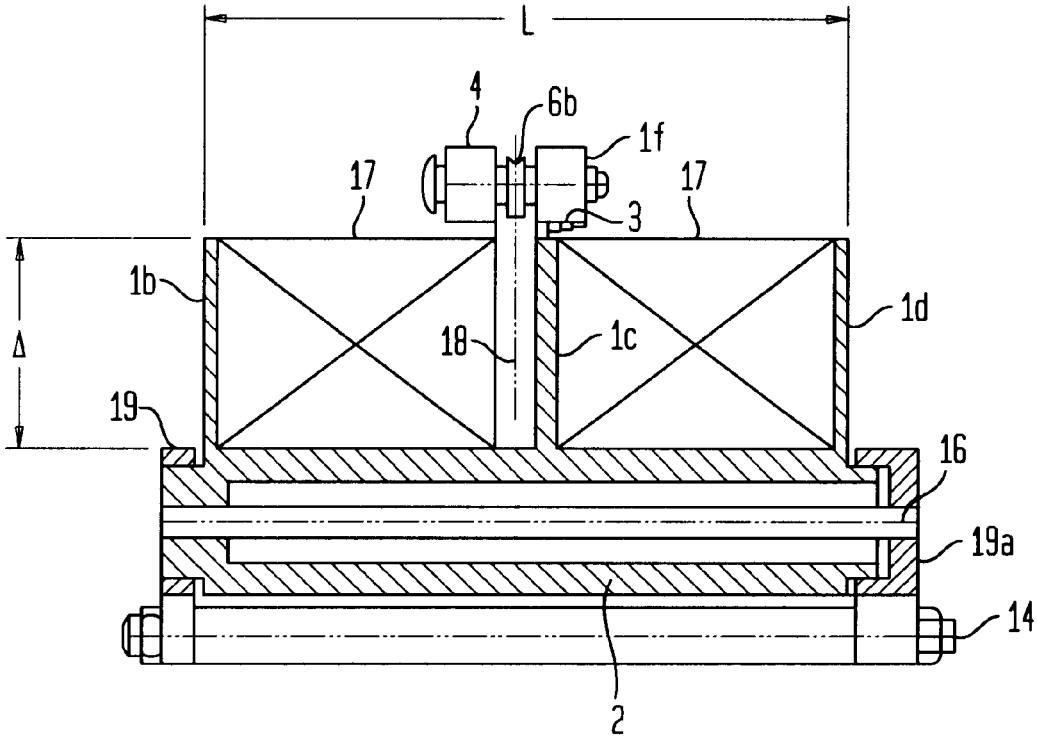
FIGS. 2*a* and 2*b*: depict the construction and bearing of the armature.
Figure 2B:
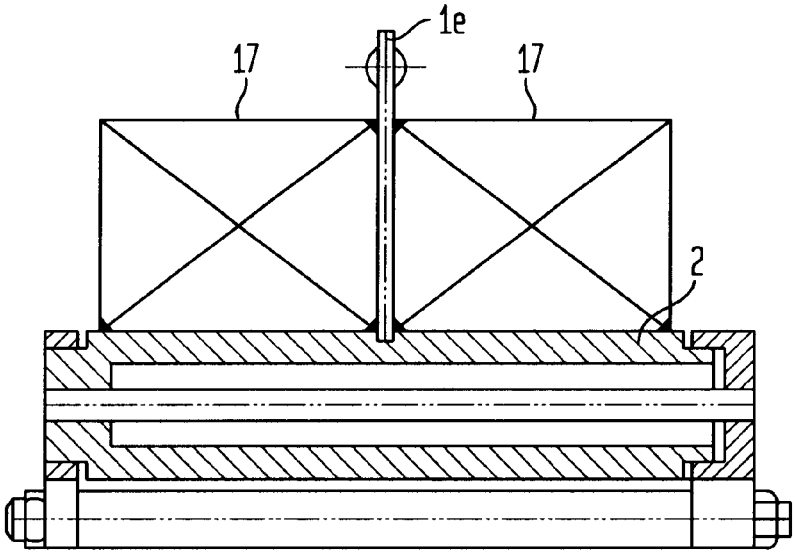

FIGS. 2*a* and 2*b* illustrate the armature tube 2 in sectional depiction. In FIG. 2*a* it is show connected to three lever sections 1*b* to 1*d* comprising the armature lever. These three lever sections include the depicted armature 17. Said armature 17 is interrupted by a valve actuation element 18, that is comprised essentially of the overstroke spring 3, the bearing housing 1*a* and the bearing 4. The armature 17 and the valve actuation element 18 are welded to the lever sections. The tube 2 is mounted for the purpose of carrying the relatively large armature forces on both sides at parts 19 and 19*a* of the housing plates 13 and 13*a* as shown in FIG. 1. Preferably roller bearings are used and the bearing is comprised of external bearings. The torsion bar 16 (torsion spring) running through the tube 2 can be completely relived of flexural stresses by these bearing points. It is connected on the one side (left) with the tube 2 and restrained on the other side in the part 19*a*. In this situation no axial play exists.

The length (depth) 1 and the width b of the armature are drawn in FIG. 2*a*. The magnet yokes situated opposite the armature have the respective dimensions.

FIG. 2*b* shows a simplified embodiment of the armature fastening. Both armature pieces 17 are welded to only one armature lever 1*e* and to the tube 2. The weld points are identified in the conventional manner by wedge-shaped, dark notches. The armature lever corresponds to FIG. 5*a*.

Figure 3:
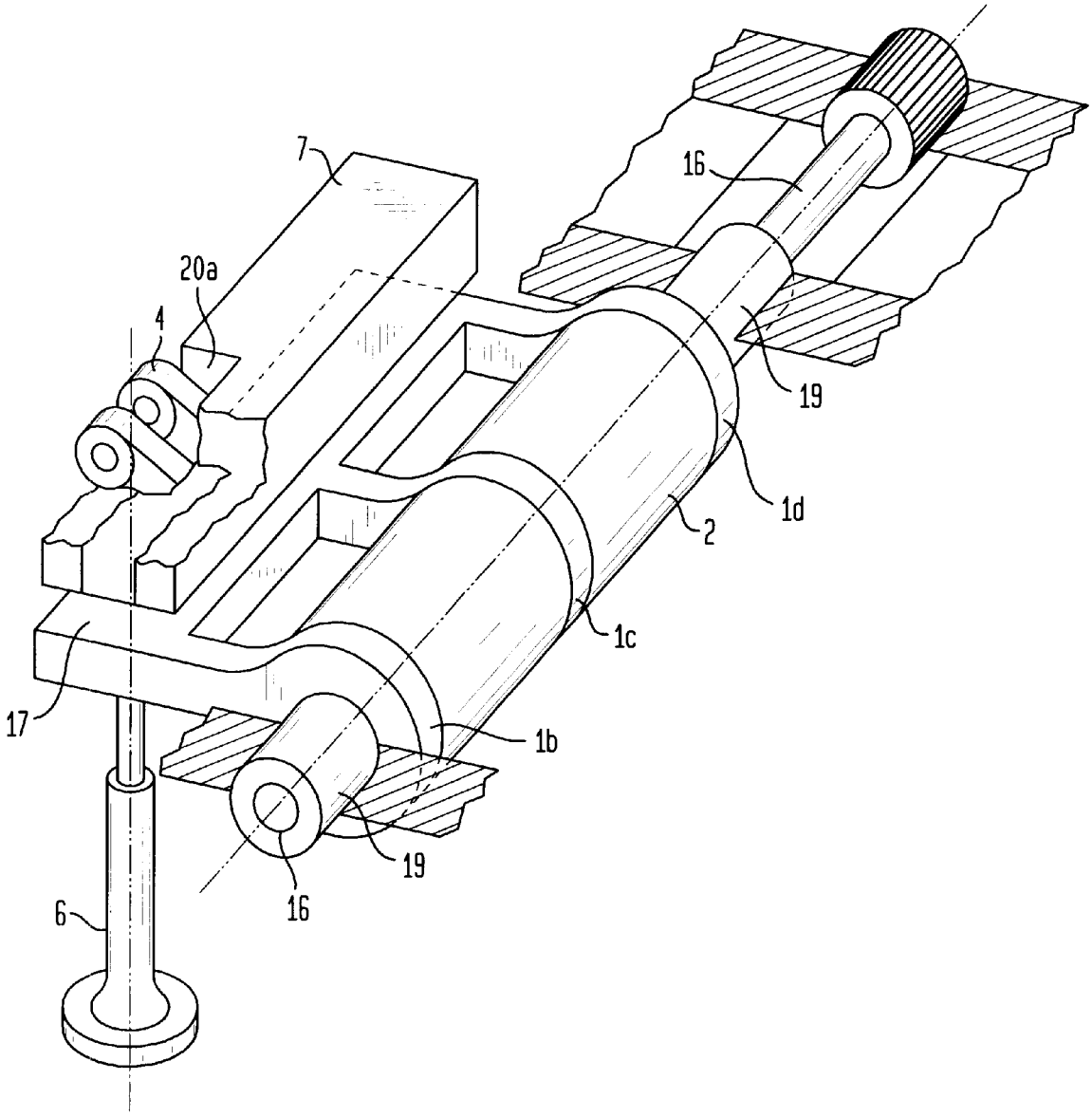
FIG. 3: depicts the electromagnetic drive of FIG. 1 in perspective.

FIG. 3 shows the arrangement in perspective depiction. The armature tube 2 is connected to the magnetically conductive armature lever 1*b* to 1*d*. Here the connection points formed during the welding process can also be seen. In order that the magnetic flux of the two magnets are not affected by the armature tube 2 the later is preferably comprised of a nonconductor or only weakly conducting or nonmagnetic material. The armature 2 is mounted in the bearing points 19 19*a* and accomodates the torsion bar. On the left half of the illustration the long magnet 7 is shown and is sectioned in the anterior portion in order to show the valve joint 4. The magnet 7 shows a recess 20*a* for interruption of the yoke for installation of 2 double coils each. This recess is also useful for the overstroke spring, which protrudes into the yoke on lifting movement. The armature is shown here too at 17. In lieu of the fulll cut out of both yoke limbs a magnetically conductive filler element can also be used. In this figure the armature is shown with an interval to the armature tube 2. It can also abut directly on the armature tube as shown in FIGS. 2*a* and 2*b*.

Figure 5C:
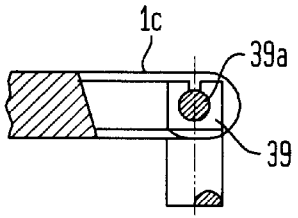
FIGS. 5, 5*a*, and 5*b* and 5*c*: depict alternative drive possibilities for the valve shaft.
Figure 5B:
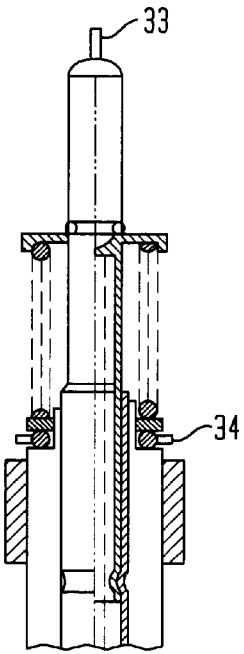
Figure 5A:
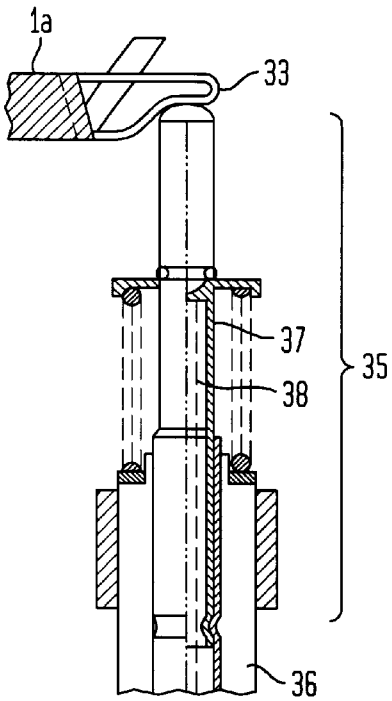
Figure 5:
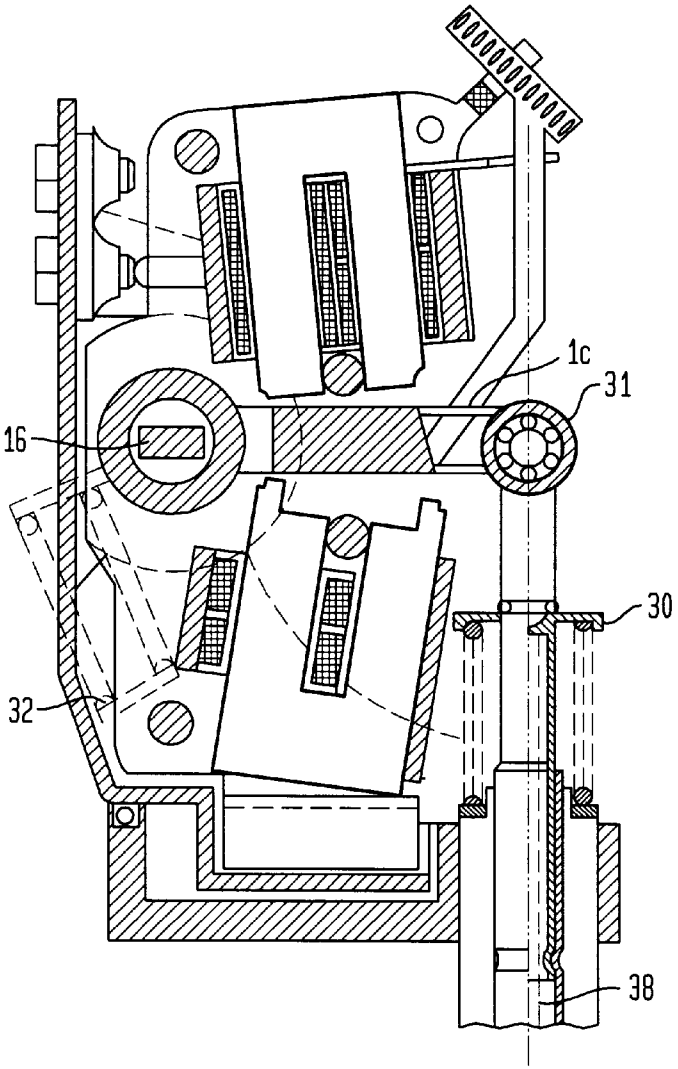

FIG. 5 shows and alternative valve actuation. The valve is, as is known in the art, is pressed by a compression spring 30 in the direction of the closed position. Here the torsion bar 16 acts against the compression spring. In the centerline drawn the elastic/spring forces are shown in equilibrium. The transfer of forces occurs via a roller 31 equipped with a roller bearing that is connected to the armature lever 1*c*. The latter is configured slightly elastic by means of its limb, in order to reduce the impact load when the valve shaft seats.

In addtion, a compression spring 32 can be attached to a relatively small lever arm and used for supporting the torsion rod 16.

FIG. 5*a* depicts in lieu of the roller a sliding element 33 that is welded into the armature and can be surface coated on the slide. This element, too, is designed to elastically reduce the impact load.

FIG. 5*b* depicts a side view. For reduction of the sliding friction on the valve shaft the compression spring bearing can be mounted in a ball bearing 34.

This and an eccentric bearing of the sliding element 33 effect a desirable valve torsion.

The drives of FIG. 5 and FIG. 5*a* do not require a flexure zone in the valve shaft because they themselves can compensate the misalignment caused by the swivel of the lever 1*c*.

The upper part of the valve shaft 35 is made of a material having low temperature expansion; for example, invarsteel and flanged or welded onto the valve shaft 36. For better temperature dissipation form the valve disk, the hollow valve shaft 36/37 is filled with sodium. The differential movement between the roller 31, or the sliding element 33 and the valve shaft 36/37 between the cold and the operationally warm valve is considerably less due to the temperature compensation and thus the bearing stress and the holding energy is considerably low.

FIG. 5*c* includes a sliding element 39 that is mounted rotatable on a shaft 39*a*. Said sliding element corresponds to the conventional cam drive via an oscillating arms or levers. It can also be mounted in a spherical calotte in order to fully adapt to the valve shaft head. Said sliding element preferably has clamping or tension device so that on touching down at the time of valve opening a slight surface pressure results.

Figure 6:
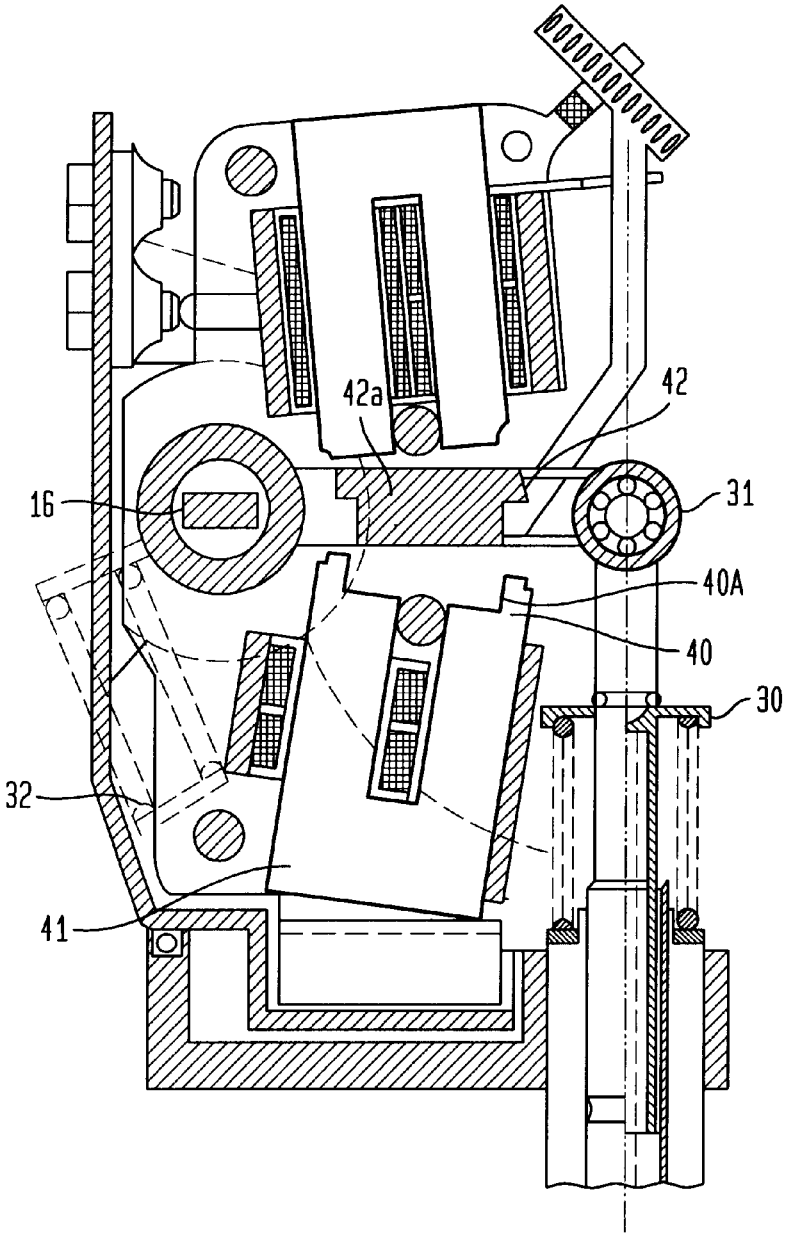
FIGS. 6 and 7: depict special armature constructions.

FIG. 6 differs from FIG. 5 only by a alternative configuration of the pole 40 of the opening magnet 41 and an appropriate configuration of the armature 42. The poles 40 are designed stepped—in this instance with two steps. The armature 42 exhibits on the side facing the opening magnet a corresponding slope such that the armature 42 fits into the opening of the stepped poles with a small air gap. For the proper effect of the magnets 41 the widths and depths 40*a* and 42*a* of the poles 40 and of the armature 42 are essential. Thus, characteristic curve formation is possible with the result that the lifting force of the magnets with large air gaps is considerably higher. This configuration of the magnets 41/42 is of particular significance in the bearing of the armature by means of the roller bearings, since relatively large shearing forces occur through tolerances in the armature.

Figure 7:
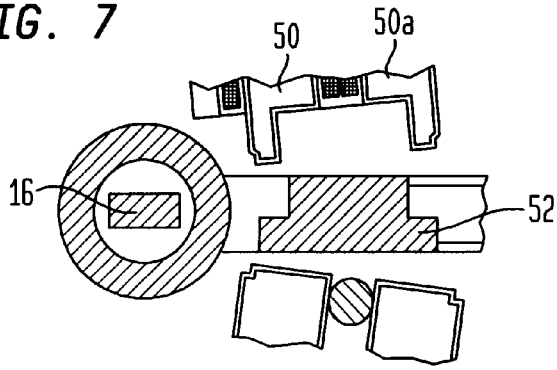

FIG. 7 shows a corresponding configuration of the poles of the closing magnets 50 and 50*a* of an inlet valve drive and of the associated armature 52.

The yokes and the armature of the opening and closing magnets of an actuator, particularly of the outlet valve drive can be configured using the characteristic curve formation mentioned above.

In FIG. 8 various versions are shown with a second torsion bar connected in parallel. In FIG. 8*a* the lever acting on the valve shaft 6 is identified with 1, the armature with 17, the bearing tube with 2, and the torsion bar with 16. A second torsion bar 16*a* with bearing tube 2*a* and a lever 1*e* is provided, whereby the elastic forces of said torsion bar 16*e* are concentrated via a connector element 60 with the forces of the torsion spring 16.

Figure 8A:
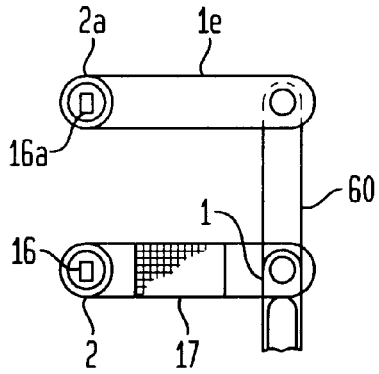
FIG. 8: depicts various arrangements with two torsion springs.
Figure 8B:
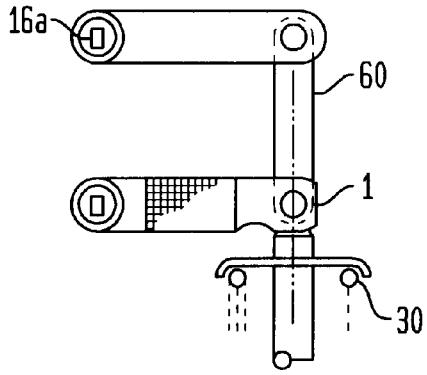

In FIG. 8*a* a valve spring 30 acts, corresponding to FIG. 5*a*, on the valve shaft and the armature movement is transferred by a sliding element 33 to the valve. Here, too, a connector element 60, transfers the forces of the second torsion spring 16*a* to the lever 1.

Figure 8C:
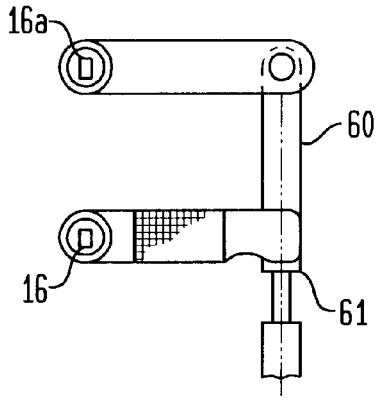

In FIG. 8*c* the valve spring 30 is replaced by the torsion bar spring 16*a* that grips over the connector element 60 under the valve shaft head 61. The torsion spring 16 acts via a sliding element on the valve shaft.

Figure 8D:
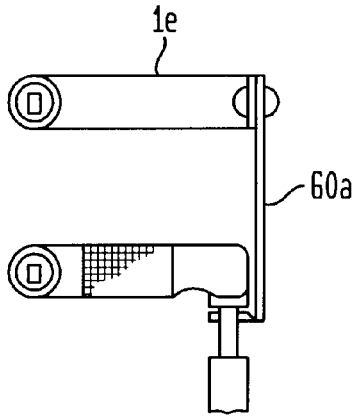

In FIG. 8*d* the connector element is not mounted rotatable on the lever 1*c* but is rigidly connected to it. The transmission element is a flat spring 60*a* that likewise grips under the valve shaft plate 61.

Figure 8E:
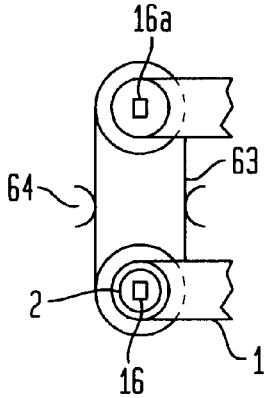

In FIG. 8*e* the second lever 1*c* is not mounted on a tube. Here, a bearing piece 63 is connected on the one side with the tube 2 of the torsion spring 16 and on the other side with a bearing of the torsion bar 16*a*. The shear forces are braced at a bearing point 64.

Figure 9:
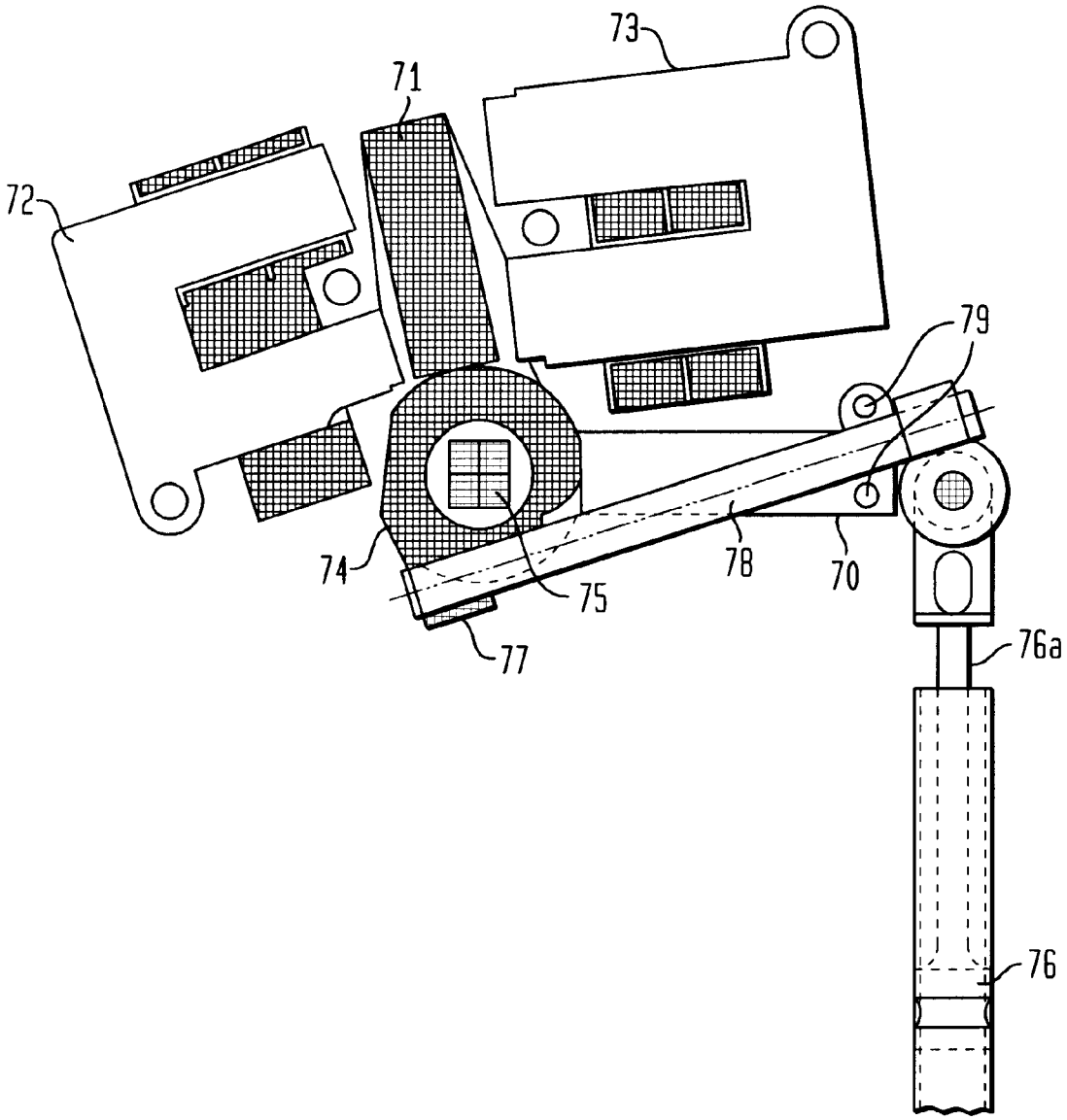
FIG. 9: depicts another construction of an electromagnetic drive.

FIG. 9 shows a configuration in which a main lever 70 is deviated by an adjunct lever 71 from the two electromagnets 72 and 73. The levers 70 and 71 are connected to a tube 74, in whose inside the torsion spring 75 is housed. The adjunct lever 71 carries the armature or represents the armature. It is configured as a long magnet.

The transfer of forces to the valve shaft 76 occurs, analogous to FIG. 1, via an overstroke spring 78 fastened at 77 to the main lever 70 at which at the anterior end of the main lever 70 two stops 79 are situated for the purpose of limitation of deflection. Here, too, a flexure zone 76*a* is provided in the valve shaft.

This arrangement exhibits an extremely low structural height, provides better use of the magnet length, has a minimal weight and decoupling of the overstroke spring from the armature is provided.

Figure 10A:
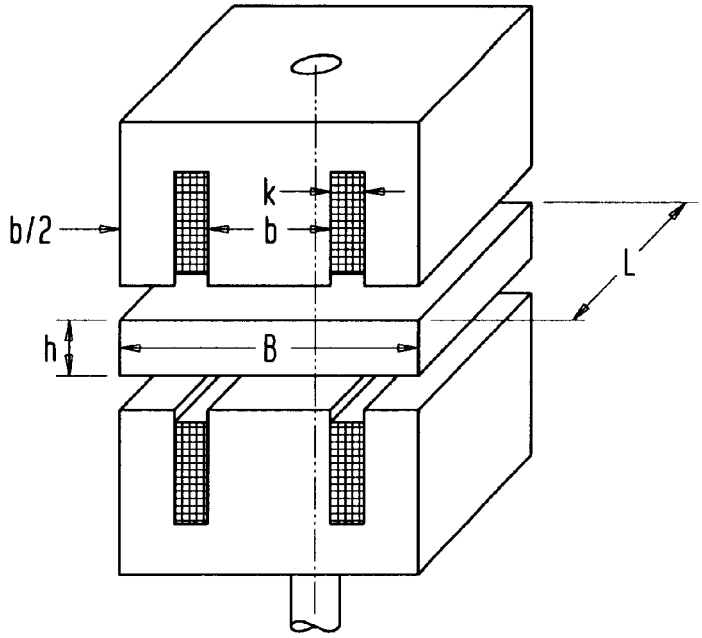
FIGS. 10*a* and 10*b*: depict the comparison of two drives with linear/point-to-point armature movement once with short and once with a long (deep) armature and the corresponding electromagnets.
Figure 10B:
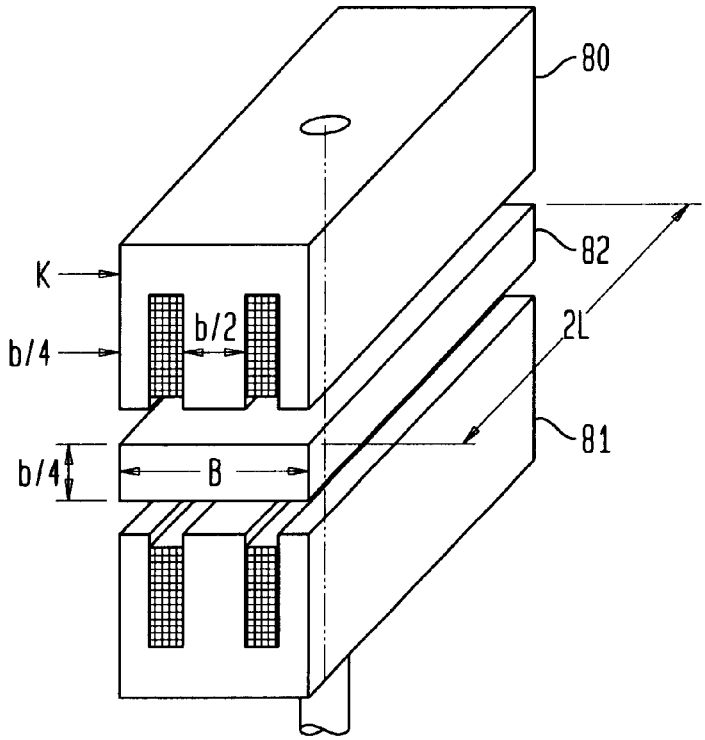

FIGS. 10*a* and 10*b*: depict the comparison of two drives with linear, point-to-point armature movement, once with short and once with a long (deep) armature and the corresponding electromagnets.

The magnets and armature in both Fig. are designed for the same flux density. The following dimensions apply:

| | FIG. 10a | FIG. 10b |
|---|---|---|
| Central Yoke Breadth | b | b/2 |
| Leg Breadth | b/2 | b/4 |
| Coil Thickness | K | K |
| Armature Height | h = b/2 | b/4 |
| Magnet Breadth | L | 2L |
| Armature Surface | (2b + 2K) L | (b + 2K) 2L |
| Armature Volume | (2b + 2K) L × b/2 | (b + 2k) 2L × b/ = (b + 2K) L × b/2 |

One can see that for FIG. 10*a* there is a dependence of 2*b* (in the brackets) and for FIG. 10*b* a dependence only on 1×b; thus, the armature volume and therefore the armature weight is clearly less.

With a comparable design corresponding to FIG. 10*a* the resulting armature weight was 72 g and in a design corresponding to FIG. 10*b* the armature weight was only 47 g.

If one substitutes for b=10, for K=2 and for L=20, then in the case of FIG. 10*a* the result is a volume of 2400 (=100%). For that of FIG. 10*b* the result is a volume of 1400, thus, approximately 58%. With a 3×length the volume is reduced to 48%.

Because of the increased magnet length (depth) the drive must, if necessary, be installed in the motor due to space considerations.

It must be mentioned that the inventive deep designed yokes of the electromagnets and correspondingly the inventive deep designed armature do not necessarily have to be fabricated in one piece but can be assembled from two or several pieces; the magnets can also be assembled from several partial magnets, whereby one or several armatures can be provided.

In the figures described above one torsion bar is provided for the production of at least part of the elastic force. It is, however, in the case of this invention also possible to produce both elastic forces, for example, by using coil springs. In the example of FIG. 5*a* the, a spring arranged in the valve axis acts on the lever 1*c* from above. A slight load of the lever bearing is achieved in this way.

FIG. 11 depicts various other possible embodiments for the electromagnet(s) as in the foregoing figures.

Figure 11A:
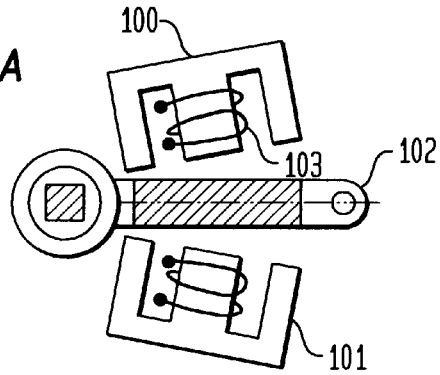
FIGS. 11*a* to 11*g*: various possible forms of the electromagnet(s).
Figure 11B:
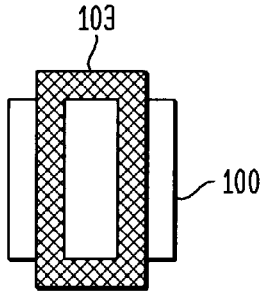
Figure 11C:
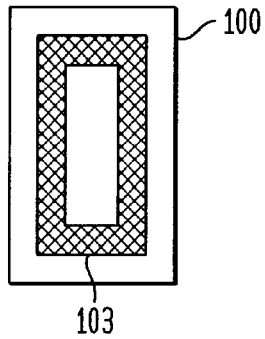
Figure 11D:
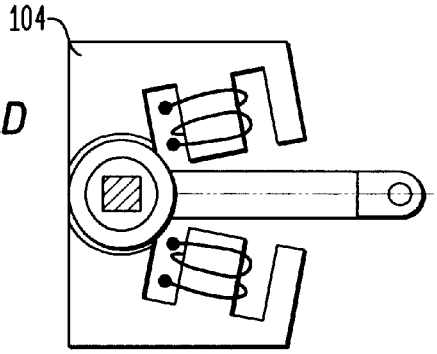

FIG. 11*a* depicts two three-pole electromagnets 100 and 101, which are situated opposite the armature 102. FIGS. 11*b* and 11*c* depict views from above of the magnet poles. The winding 103 can be produced to correspond to FIG. 11*b* or as a pot-coil corresponding to FIG. 11*c*. In FIG. 11*d* two three-pole electromagnets are depicted, whereby in this case one pole 104 is not active; that is, it is does not contribute to the lifting work. Also and analogous thereto is the possibility of executing the electromagnets as two-pole magnets and then to use only one of them as the active.

Figure 11E:
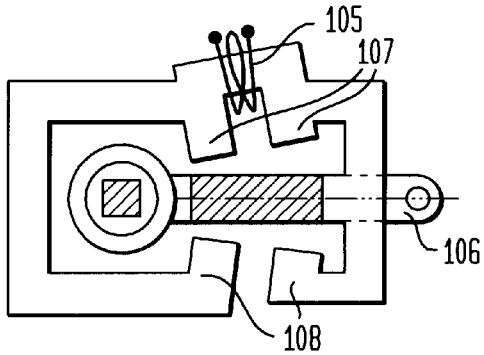
Figure 11F:
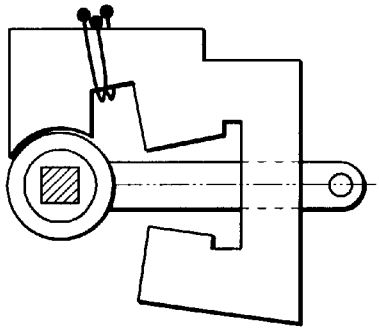

In the example of FIG. 11*e* only one winding 105 is provided, whereby depending on the location of the armature 106, pole 107 or 108 is effective. If the armature is brought into the proximity of pole 107 or 108 by the effect of the elastic forces, then the winding 105 can be switched on and the armature will accelerate in the direction of the respective pole. In order to achieve a buildup from the intermediate position either the intermediate position must be asymmetrical or the pole of an electromagnet must be more powerfully designed. Finally, in FIG. 11*f* a combination of FIG. 11*e* with the use of only one active pole is depicted.

Figure 11G:
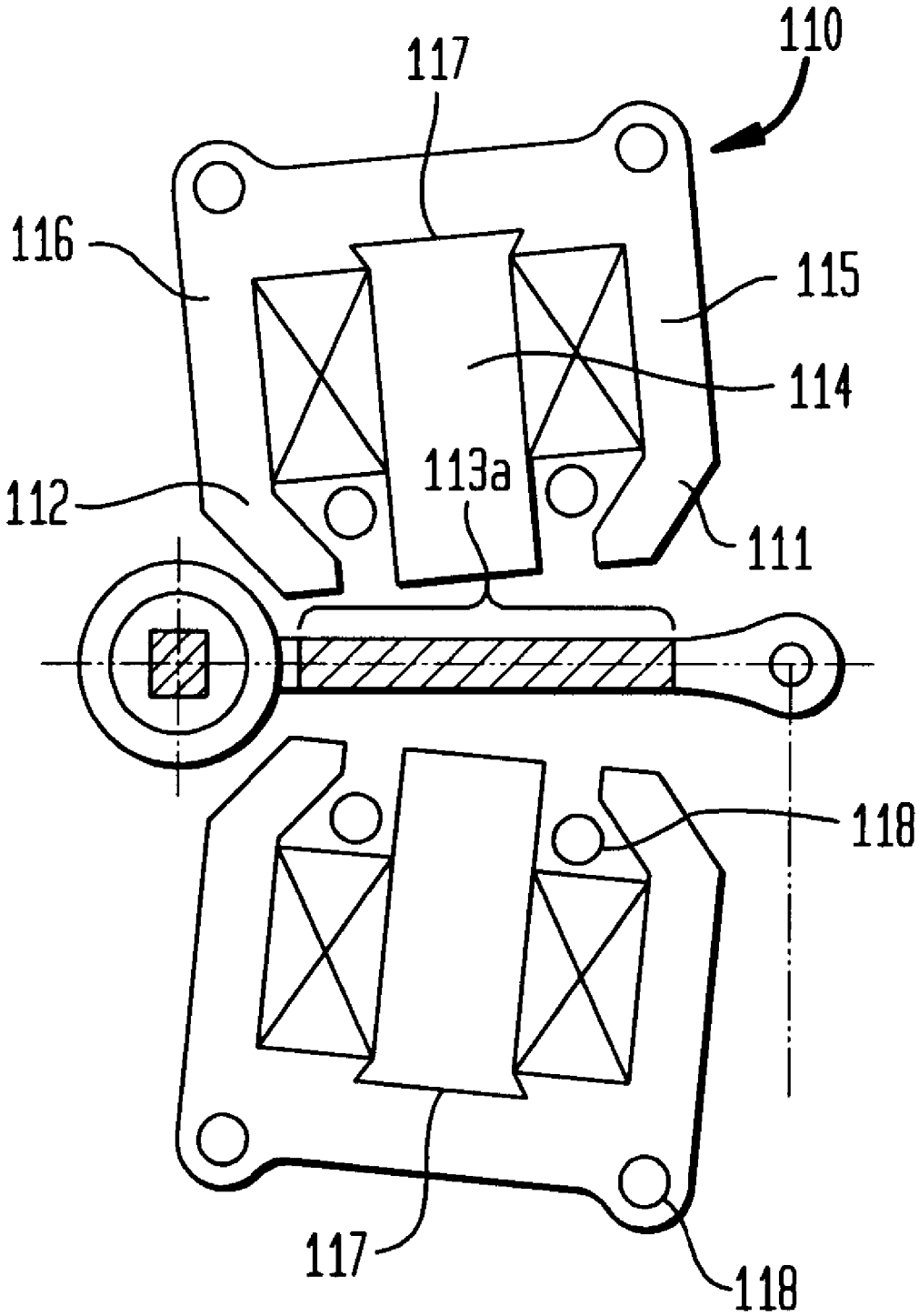

The magnetic circuit 110 of FIG. 11*g* corresponds to an e-core corresponding to FIGS. 11*a* and 11*b*.

The pole interval of the external limbs 111 and 112 is as small as possible in order to keep the width 113*a* of the armature 113 as small as possible. For the purpose of reducing the scatter flux between the middle limb 114 and the outside limbs and in order to illustrate a large angular space the external magnetic circuit 115 and 116 is opened up. The middle limb 114 is preferably comprised of grain-oriented material and is interlocking; that is, dove-tailing 117 is inserted into the yoke or is welded to it.

The armature thickness in the case of the e-magnets approximates that of the thickness of the external limb 115 and 116, which again is about 50% of the width of the middle limb 114. Thus, the thickness of the armature 113 is only about 50% of the armature thickness of a U-magnet.

Without special procedures the pole interval in the e-magnets is large than in the U-magnets. Through the procedure of expansion or opening up this disadvantage can be minimized. The effective savings in weight in this type of magment is about 40% compared to the U-magnets.

A further advantage is to be found in the co-employment of the middle limb 113 as the core of the winding 119. This is particularly advantageous in the case of strip or band coils. Thus, an excellent fill factor can be achieved. This is of essential significance, since the dissipation rate of the coil is very strongly dependent on the angular space and the fill factor.

In the case of the e-core there is yet another opportunity to use four torsion screws 118 in contrast with the three in the U-core, which is very favorable with respect to the symmetry of the expansion force.

With respect to the execution forms; that is corresponding to FIG. 11 with approximating pole terminals towards the armature, it must be noted that the definition pursuant to Claim 1 Depth to Width of the yoke greater than 1.5, etc. refers to the yoke width at the ends of the yokes and not to the yoke width lying more distally.

While the invention has been described with reference to the preferred embodiment thereof, it would be appreciated by those of ordinary skilled in the art that modifications can be made to the structure and method of the invention without departing from the spirit and scope of the invention as a whole.

What is claimed is:

1. An electromagnetic drive having a movable armature (17) that can be electromagnetically moved laterally point-to-point and which is moved by at least one electromagnet (7, 8) into final positions, whereby a valve element (6), of an internal combustion engine, is driven by the movement of the armature (17), characterized by the fact that the ratio of the depth to the width of the yokes of the electromagnets (7, 8) and the ratio of the depth to the width of the armature (17) are both greater than 1.5.

2. An electromagnetic drive according to claim 1, characterized by the fact that two elastic forces (18) are mounted opposite one another and act upon the armature (17) and position the armature (17) in an intermediate position without the action of excitation currents.

3. An electromagnetic drive according to claim 2, characterized by the fact that with a swivel-mounted armature the two elastic forces are formed at least in part by a torsion spring (16).

4. An electromagnetic drive according to claim 2, characterized by the fact that that the two elastic forces are formed at least in part by traction and/or compression springs.

5. An electromagnetic drive claim 2, characterized by the fact that a valve spring (30) is provided whose elastic force acts upon the valve shaft (36) in the direction of the closed position of the valve.

6. An electromagnetic drive according to claim 1, characterized by the fact that with a rotatably mounted armature (17) or an armature (17) supported by a rotatably mounted lever (1) the armature (17) or the lever (1) is connected with a rotatably mounted tube (2) or tube-like part, that said tube (2) or part is connected with a torsion spring (16) running at least partially in the tube or part and that the tube (2) or part is mounted externally.

7. An electromagnetic drive according to claim 6, characterized by the fact that the armature (17) is connected to the tube via at least two partial levers **(1*b* to 1*d*)** arranged parallel to and separated from one another.

8. An electromagnetic drive according to claim 6 and characterized by the fact that an overstroke spring (3) is incorporated in the lever (1), via which the armature movement is transmitted to the valve element and which is rigid for said movement to be transmitted and is only effective as a cushion/spring in the event of high stress/load (overstroke).

9. An electromagnetic drive according to claim 6, characterized by the fact that the part of the lever **(1*a*) that drives the valve element (6) exhibits a joint (4) to which the valve element (6)** is connected.

10. An electromagnetic drive according to claim 6, characterized by the fact that the valve element to be driven is the valve stem of a valve and that the valve stem of the valve is of a flexible design.

11. An electromagnetic drive according to claim 6, characterized by the fact that that the lever **(1, 1*a*) lies loosely on the shaft (36, 37)** of the valve.

12. An electromagnetic drive according to claim 11, characterized by the fact that the lever **(1, 1*a*) acts upon the valve shaft by way of a roller (31)**.

13. An electromagnetic drive according to claim 11, characterized by the fact that the lever **(1, 1*a*) acts upon the valve shaft (36, 37) by way of a sliding element (33)**.

14. An electromagnetic drive according to claim 11, characterized by the fact that the lever acts upon the valve shaft eccentrically.

15. An electromagnetic drive according claim 1, characterized by the fact that the material of the magnet core (7, 8) and/or of the armature (17) is grain-oriented.

16. An electromagnetic drive according to claim 15, characterized by the fact that the magnet cored of the electromagnets (7, 8) in zones **(7*a*, 8*a*)** exhibit a larger cross-section with a change in direction of the yokes.

17. An electromagnetic drive according to claim 1, characterized by the fact that the magnet core of the electromagnets is executed in one piece (FIG. 1).

18. An electromagnetic drive according to claim 1, characterized by the fact that at least on one yoke of a magnet and towards the pole surface a division of the yoke into at least two yoke sections **(7*b*) is provided (FIG. 4) and that at least two coils (13, 13*a*) are arranged on said yoke sections and that said coils (13, 13*a*) are connected in parallel (FIG. 4**).

19. An electromagnetic drive according to claim 1, characterized by the fact that at least one additional coil **(13*c*) is arranged on the yoke of the closing magnet (7)**, said coil serving to hold the valve in the respective position.

20. An electromagnetic drive according to claim 1, characterized by the fact that the magnet core of the electromagnets (7, 8) are retained and arranged between two plates (13) of the housing.

21. An electromagnetic drive according to claim 20, characterized by the fact that the orientation of the yokes to the armature (17) is rotatable.

22. An electromagnetic drive according to claim 20, characterized by the fact that the coils (9, 10, 11) are in thermal conducting conjunction with the plates (13) of the housing via the yokes.

23. An electromagnetic drive according to claim 22, characterized by the fact that filler elements (15) are provided between the coils (9, 11, 12) and the yokes for the purpose of heat dissipation.

24. An electromagnetic drive according to claim 20, characterized by the fact that finning or ribbing is provided for heat loss.

25. An electromagnetic drive according to claim 6, characterized by the fact that for adjustment of the entire drive is rotatable around the tube axis or around an axis lying more distally from the armature.

26. An electromagnetic drive according to claim 3, characterized by the fact that the torsion spring (16) is designed as a rod with a rectangular cross-section.

27. An electromagnetic drive according to claim 1, characterized by the fact that seen in cross-section, the poles (40 of at least one of the electromagnets (7, 8)) are designed in steps (40*a*) and that the armature (42) when viewed in cross-section exhibits a therein interlocking counter-stepping (42*a*).

28. An electromagnetic drive according to claim 27, characterized by the fact that the opening magnet of the outlet valve exhibits such a stepping.

29. An electromagnetic drive according to claim 27, characterized by the fact that the closing magnet of the outlet valve exhibits such a stepping.

30. An electromagnetic drive according to claim 13, characterized by the fact that the sliding element (30) on the lever (1*c*) is rotatable (Shaft 39*a*) (FIG. 5*c*).

31. An electromagnetic drive according to claim 30, characterized by the fact that the sliding element is mounted on the lever by means of a ball and a ball cup.

32. An electromagnetic drive according to claim 6, characterized by the fact that a main lever (70) for actuation of the element (for example, the valve shaft 76) and an ancillary lever (71) representing the armature or carrying it, at an angle opposite the main lever (70) and connected with the main lever, are provided.

33. An electromagnetic drive according to claim 3, further comprising a first torsion spring (16) and a second torsion spring (16*a*) and characterized by the fact that for at least the partial production of the elastic force, said first and second torsion springs (16, 16*a*) are arranged in parallel to each other.

34. An electromagnetic drive according to claim 33, further comprising two levers (1, 1*e*) and characterized by the fact that each of said torsion springs (6, 16*a*) is connected with one of said levers (1, 1*e*) via a tube (2, 2*a*), whereby the transmitted forces act upon the valve shaft by way of said two levers (1, 1*e*).

35. An electromagnetic drive according to claim 33, further comprising a first lever (1) and a second lever (1*e*) and characterized by the fact that said first lever (1) is connected with said first torsion springs (16) by way of a tube (2) and said second lever (1*e*) is connected directly with said second torsion spring (16*a*).

36. An electromagnetic drive according to claim 1, characterized by the fact that the yokes of the electromagnets (7, 8) and/or the armature (17) are assembled from two or more parts.

37. An electromagnetic drive according to claim 36, characterized by the fact that several magnets are arranged in sequence opposite which a one-piece or multiple-piece armature is situated.

38. An electromagnetic drive according to claim 6, characterized by the fact that the range of effect of the forces of the armature or of the lever (3) carrying the armature on the valve shaft (6) lies outside of the effective area of at least one electromagnet.

39. An electromagnetic drive according to claim 1, characterized by the fact that at least one of the magnets exhibits an e-core (110), whereby the ends (111, 112) of the outside limbs run towards the middle limb (114).

40. An electromagnetic drive according to claim 39, characterized by the fact that that the middle limb (114) is the carrier of the winding (119) (preferably a strip coil).

41. An electromagnetic drive according to claim 39, characterized by the fact that the middle limb (114) is connected with the core (115/116) by welding and/or by a dove-tail interlocking connection (117).

42. An electromagnetic drive according claim 39, characterized by the fact that that the middle limb (114) is comprised of grain-oriented material.

43. An electromagnetic drive according to claim 1, characterized by the fact that the ratio of the depth to the width of the yokes of the electromagnets (7, 8) and the ratio of the depth to the width of the armature (17) are both greater than 2.

44. An electromagnetic drive according to claim 1, characterized by the fact that the ratio of the depth to the width of the yokes of the electromagnets (7, 8) and the ratio of the depth to the width of the armature (17) are both greater than 3.

* * * * *